US010522161B2

(12) United States Patent
Nagisetty et al.

(10) Patent No.: US 10,522,161 B2
(45) **Date of Patent: *Dec. 31, 2019**

(54) DEVICE AND METHOD FOR BANDWIDTH EXTENSION FOR AUDIO SIGNALS

(71) Applicant: Fraunhofer-Gesellschaft zur Foerderung der angewandten Forschung e.V., Munich (DE)

(72) Inventors: Srikanth Nagisetty, Singapore (SG); Zongxian Liu, Singapore (SG)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/219,656

(22) Filed: Dec. 13, 2018

(65) Prior Publication Data

US 2019/0122679 A1 Apr. 25, 2019

Related U.S. Application Data

(63) Continuation of application No. 15/659,023, filed on Jul. 25, 2017, now Pat. No. 10,157,622, which is a (Continued)

(30) Foreign Application Priority Data

Jun. 11, 2013 (JP) ..... 2013-122985

(51) Int. Cl.
*G10L 19/00* (2013.01)
*G10L 19/02* (2013.01)
(Continued)

(52) U.S. Cl.
CPC ..... *G10L 19/0204* (2013.01); *G10L 19/167* (2013.01); *G10L 19/24* (2013.01);
(Continued)

(58) Field of Classification Search
CPC ... G10L 19/24; G10L 21/038; G10L 19/0204; G10L 19/12; G10L 19/005; G10L 19/032;
(Continued)

(56) References Cited

U.S. PATENT DOCUMENTS 7,260,541 B2 8/2007 Tsushima et al.
7,668,711 B2 * 2/2010 Chong ..... G10L 19/032 704/219
(Continued)

FOREIGN PATENT DOCUMENTS

CN 1465137 A 12/2003
CN 1849648 A 10/2006
(Continued)

OTHER PUBLICATIONS

"Frame error robust narrow-band and wideband embedded variable bit-rate coding of speech and audio from 8-32 kbit/s", Int'l Telecommunication Union; Recommendation ITU-"T G.718 (2008)-Amendment 2" New Annex B on superwideband scalable extension for ITU-T G.718 and corrections to main body fixed-point C-code and description text; Mar. 2010, 60 pages.
(Continued)

*Primary Examiner* — Edgar X Guerra-Erazo
(74) *Attorney, Agent, or Firm* — Michael A. Glenn; Perkins Coie LLP

(57) ABSTRACT

An audio signal decoding apparatus is provided that includes a receiver that receives an encoded information, a memory, and a processor that demultiplexes the encoded information, including encoding parameters that are used for decoding a low frequency spectrum and index information that identifies a most, correlated portion from a low frequency spectrum for one or more high frequency subbands. The processor also replicates a high frequency subband spectrum based on the index information using a synthesized low frequency
(Continued)

spectrum, the synthesized low frequency spectrum being obtained by decoding the encoding parameters. The processor further estimates a frequency of a harmonic component in the synthesized low frequency spectrum, adjusts a frequency of a harmonic component in the high frequency subband spectrum using the estimated harmonic frequency, and generates an output signal using the synthesized low frequency spectrum and the high frequency subband spectrum.

20 Claims, 14 Drawing Sheets

Related U.S. Application Data continuation of application No. 15/286,030, filed on Oct. 5, 2016, now Pat. No. 9,747,908, which is a continuation of application No. 14/894,062, filed as application No. PCT/JP2014/003103 on Jun. 10, 2014, now Pat. No. 9,489,959.

(51) Int. Cl.

| | |
|---|---|
| ***G10L 19/24*** | (2013.01) |
| ***G10L 21/038*** | (2013.01) |
| ***G10L 19/16*** | (2013.01) |
| *G10L 19/035* | (2013.01) |
| *G10L 25/18* | (2013.01) |

(52) U.S. Cl.
CPC ..... *G10L 21/038* (2013.01); *G10L 19/035* (2013.01); *G10L 25/18* (2013.01)

(58) Field of Classification Search
CPC ..... G10L 19/18; G10L 19/22; G10L 25/18; G10L 19/02; G10L 19/0208; G06F 17/147
See application file for complete search history.

(56) References Cited

U.S. PATENT DOCUMENTS

| | | | | |
|---|---|---|---|---|
| 7,769,584 | B2 | 8/2010 | Oshikiri et al. | |
| 7,949,057 | B2 | 5/2011 | Oshikiri | |
| 8,135,593 | B2 | 3/2012 | Miao et al. | |
| 8,208,570 | B2 | 6/2012 | Yokosuka | |
| 8,275,061 | B2 | 9/2012 | Oshikiri | |
| 8,315,322 | B2 | 11/2012 | Oshikiri | |
| 8,515,747 | B2 | 8/2013 | Gao | |
| 8,532,998 | B2 | 9/2013 | Gao | |
| 8,818,541 | B2 | 8/2014 | Villemoes et al. | |
| 8,831,958 | B2 | 9/2014 | Lee et al. | |
| 8,924,222 | B2 | 12/2014 | Rajendran et al. | |
| 9,093,080 | B2 * | 7/2015 | Ishikawa | G10L 21/038 |
| 9,105,263 | B2 | 8/2015 | Qi et al. | |
| 9,117,459 | B2 * | 8/2015 | Kjoerling | G10L 21/038 |
| 9,489,959 | B2 * | 11/2016 | Nagisetty | G10L 19/24 |
| 9,640,184 | B2 * | 5/2017 | Kjoerling | G10L 21/038 |
| 9,747,908 | B2 * | 8/2017 | Nagisetty | G10L 19/24 |
| 9,799,342 | B2 * | 10/2017 | Ishikawa | G10L 21/038 |
| 9,911,431 | B2 * | 3/2018 | Kjoerling | G10L 21/038 |
| 2004/0028244 | A1 | 2/2004 | Tsushima et al. | |
| 2007/0071116 | A1 | 3/2007 | Oshikiri | |
| 2007/0156397 | A1 * | 7/2007 | Chong | G10L 19/032 704/229 |
| 2007/0299655 | A1 | 12/2007 | Laaksonen et al. | |
| 2008/0052066 | A1 | 2/2008 | Oshikiri et al. | |
| 2010/0063802 | A1 | 3/2010 | Gao | |
| 2010/0063803 | A1 | 3/2010 | Gao | |
| 2010/0063806 | A1 | 3/2010 | Gao | |
| 2010/0063827 | A1 | 3/2010 | Gao | |
| 2010/0114583 | A1 | 5/2010 | Lee et al. | |
| 2010/0250261 | A1 | 9/2010 | Laaksonen et al. | |
| 2011/0194598 | A1 | 8/2011 | Miao et al. | |
| 2011/0194635 | A1 | 8/2011 | Oshikiri | |
| 2011/0196674 | A1 | 8/2011 | Oshikiri | |
| 2011/0196686 | A1 | 8/2011 | Oshikiri | |
| 2011/0282675 | A1 | 11/2011 | Nagel et al. | |
| 2011/0305352 | A1 | 12/2011 | Villemoes et al. | |
| 2011/0307248 | A1 | 12/2011 | Yamanashi et al. | |
| 2012/0029923 | A1 | 2/2012 | Rajendran et al. | |
| 2012/0136670 | A1 * | 5/2012 | Ishikawa | G10L 21/038 704/500 |
| 2012/0209597 | A1 | 8/2012 | Yamanashi | |
| 2012/0328124 | A1 * | 12/2012 | Kjoerling | G10L 21/038 381/98 |
| 2013/0018660 | A1 | 1/2013 | Qi et al. | |
| 2013/0030796 | A1 | 1/2013 | Liu | |
| 2014/0200901 | A1 | 7/2014 | Kawashima et al. | |
| 2015/0248894 | A1 * | 9/2015 | Ishikawa | G10L 21/038 704/500 |
| 2015/0317986 | A1 * | 11/2015 | Kjoerling | G10L 21/038 704/205 |
| 2017/0178665 | A1 * | 6/2017 | Kjoerling | G10L 21/038 |
| 2017/0358307 | A1 * | 12/2017 | Ishikawa | G10L 21/038 |
| 2018/0144753 | A1 * | 5/2018 | Kjoerling | G10L 21/038 |

FOREIGN PATENT DOCUMENTS

| | | | |
|---|---|---|---|
| CN | 101656073 | A | 2/2010 |
| CN | 102334159 | A | 1/2012 |
| CN | 102598123 | A | 7/2012 |
| EP | 1351401 | A1 | 10/2003 |
| EP | 1657710 | A1 | 5/2006 |
| EP | 2221808 | A1 | 8/2010 |
| EP | 2221808 | B1 | 7/2012 |
| JP | 2003108197 | A | 4/2003 |
| JP | 2011100159 | A | 5/2011 |
| RU | 2483368 | C2 | 5/2013 |
| WO | 2005/027095 | A1 | 3/2005 |
| WO | 2010/036061 | A2 | 4/2010 |
| WO | 2010/081892 | A2 | 7/2010 |
| WO | 2010/081892 | A3 | 11/2010 |
| WO | 2012/016110 | A2 | 2/2012 |
| WO | 2012/050023 | A1 | 4/2012 |
| WO | 2012/111767 | A1 | 8/2012 |

OTHER PUBLICATIONS

Hiwasaki, Y. et al., "ITU-T G.711.1: extending G.711 to higher-quality wideband speech", IEEE Communications Magazine, vol. 47, No. 10, pp. 110-116, Oct. 2009, pp. 110-116.

Miao, Lei et al., "G711.1 Annex D and G.722 Annex B—New ITU-T Superwideband CODECS", In the proceedings of ICASSP; Prague, Czech Republic, May 2011, pp. 5232-5235.

Oh, Kosangrok et al., "Sinusoidal Coding and Spectral Band Replication for Low Bit-Rate Super-Wideband Speech and Audio Coding", International Journal of Multimedia and Ubiquitous Engineering, vol. 8, No. 5 (2013), pp. 51-60, 2013.

Tammi, Mikko et al., "Scalable Superwideband Extension for Wideband Coding", IEEE Int'l Conf. on Acoustics, Speech, and Signal Processing (ICASSP 2009); Taipei, Taiwan, Apr. 19, 2009, pp. 161-164.

Max Neuendorf, et al., "MPEG Unified Speech and Audio Coding—The ISO/MPEG Standard for High-Efficiency Audio Coding of all Content Types", Audio Engineering Society Convention 132. Apr. 26, 2012, Apr. 26-29, 2012.

David Gerhard, et al., "Pitch Extraction and Fundamental Frequency: History and Current Techniques", Regina, Canada: Department of Computer Science, University of Regina, Nov. 2003.

* cited by examiner

DEVICE AND METHOD FOR BANDWIDTH EXTENSION FOR AUDIO SIGNALS

CROSS REFERENCE TO RELATED APPLICATIONS

This is a continuation application of pending U.S. patent application Ser. No. 15/659,023, filed Jul. 25, 2017, which is a continuation application of U.S. patent application Ser. No. 15/286,030, filed Oct. 5, 2016, now U.S. Pat. No. 9,747,908 issued Aug. 29, 2017, which is a continuation application of U.S. patent application Ser. No. 14/894,062, filed Nov. 25, 2015, now U.S. Pat. No. 9,489,959 issued Nov. 8, 2016, which is a U.S. National Stage of International Application No. PCT/JP2014/003103 filed Jun. 10, 2014, which claims the benefit of Japanese Application No. 2013-122985, filed Jun. 11, 2013, the contents of all of which are expressly incorporated by reference herein in their entireties.

TECHNICAL FIELD

The present invention relates to audio signal processing, and particularly to audio signal encoding and decoding processing for audio signal bandwidth extension.

BACKGROUND ART

In communications, to utilize the network resources more efficiently, audio codecs are adopted to compress audio signals at low bitrates with an acceptable range of subjective quality. Accordingly, there is a need to increase the compression efficiency to overcome the bitrate constraints when encoding an audio signal.

Bandwidth extension (BWE) is a widely used technique in encoding an audio signal to efficiently compress wideband (WB) or super-wideband (SWB) audio signals at a low bitrate. In encoding, BWE parametrically represents a high frequency band signal utilizing the decoded low frequency band signal. That is, BWE searches for and identifies a portion similar to a subband of the high frequency band signal from the low frequency band signal of the audio signal, and encodes parameters which identify the similar portion and transmit the parameters, while BWE enables high frequency band signal to be resynthesized utilizing the low frequency band signal at a signal-receiving side. It is possible to reduce the amount of parameter information to be transmitted, by utilizing a similar portion of the low frequency band signal, instead of directly encoding the high frequency band signal, thus increasing the compression efficiency.

One of the audio/speech codecs which utilize BWE functionality is G.718-SWB, whose target applications are VoIP devices, video-conference equipments, teleconference equipments and mobile phones.

The configuration of G.718-SWB [1] is illustrated in FIGS. 1 and 2 (see, e.g., Non-Patent Literature (hereinafter, referred to as "NPL") 1).

At an encoding apparatus side illustrated in FIG. 1, the audio signal (hereinafter, referred to as input signal) sampled at 32 kHz is firstly down-sampled to 16 kHz (101). The down-sampled signal is encoded by the G.718 core encoding section (102). The SWB bandwidth extension is performed in MDCT domain. The 32 kHz input signal is transformed to MDCT domain (103) and processed through a tonality estimation section (104). Based on the estimated tonality of the input signal (105), generic mode (106) or sinusoidal mode (108) is used for encoding the first layer of SWB. Higher SWB layers are encoded using additional sinusoids (107 and 109).

The generic mode is used when the input frame signal is not considered to be tonal. In the generic mode, the MDCT coefficients (spectrum) of the WB signal encoded by a G.718 core encoding section are utilized to encode the SWB MDCT coefficients (spectrum). The SWB frequency band (7 to 14 kHz) is split into several subbands, and the most correlated portion is searched for every subband from the encoded and normalized WB MDCT coefficients. Then, a gain of the most correlated portion is calculated in terms of scale such that the amplitude level of SWB subband is reproduced to obtain parametric representation of the high frequency component of SWB signal.

The sinusoidal mode encoding is used in frames that are classified as tonal. In the sinusoidal mode, the SWB signal is generated by adding a finite set of sinusoidal components to the SWB spectrum.

At a decoding apparatus side illustrated in FIG. 2, the G.718 core codec decodes the WB signal at 16 kHz sampling rate (201). The WB signal is post-processed (202), and then up-sampled (203) to 32 kHz sampling rate. The SWB frequency components are reconstructed by SWB bandwidth extension. The SWB bandwidth extension is mainly performed in MDCT domain. Generic mode (204) and sinusoidal mode (205) are used for decoding the first layer of the SWB. Higher SWB layers are decoded using an additional sinusoidal mode (206 and 207). The reconstructed SWB MDCT coefficients are transformed to a time domain (208) followed by post-processing (209), and then added to the WB signal decoded, by the G.718 core decoding section to reconstruct the SWB output signal in the time domain.

CITATION LIST

Non-Patent Literature

NPL 1: ITU-T Recommendation G.71B Amendment 2, New Annex B on super wideband scalable extension for ITU-T G.718 and corrections to main body fixed-point C-code and description text, March 2010.

SUMMARY OF INVENTION

Technical Problem

As it can be seen in G.718-SWB configuration, the input signal SWB bandwidth extension is performed by either sinusoidal mode or generic mode.

For generic encoding mechanism, for example, high frequency components are generated (obtained) by searching for the most correlated portion from the WB spectrum. This type of approach usually suffers from performance problems especially for signals with harmonics. This approach doesn't maintain the harmonic relationship between the low frequency band harmonic components (tonal components) and the replicated high frequency band tonal components at all, which becomes the cause of ambiguous spectra that degrade the auditory quality.

Therefore, in order to suppress the perceived noise (or artifacts), which is generated due to ambiguous spectra or due to disturbance in the replicated high frequency band signal spectrum (high frequency spectrum), it is desirable to maintain the harmonic relationship between the low frequency band signal spectrum (low frequency spectrum) and the high frequency spectrum.

In order to solve this problem, G.718-SWB configuration is equipped with the sinusoidal mode. The sinusoidal mode encodes important tonal components using a sinusoidal wave, and thus it can maintain the harmonic structure well. However, the resultant sound quality is not good enough only by simply encoding the SWB component with artificial tonal signals.

Solution to Problem

An object of the present invention is to improve the performance of encoding a signal with harmonics, which causes the performance problems in the above-described generic mode, and to provide an efficient method for maintaining the harmonic structure of the tonal component between the low frequency spectrum and the replicated high frequency spectrum, while maintaining the fine structure of the spectra. Firstly, a relationship between the low frequency spectrum tonal component and the high frequency spectrum tonal component is obtained by estimating a harmonic frequency value from the WB spectrum. Then, the low frequency spectrum encoded at the encoding apparatus side is decoded, and, according to index information, a portion which is the most correlated with a subband of the high frequency spectrum is copied into the high frequency band with being adjusted in energy levels, thereby replicating the high frequency spectrum. The frequency of the tonal component in the replicated high frequency spectrum is identified or adjusted based on an estimated harmonic frequency value.

The harmonic relationship between, the low frequency spectrum tonal components and the replicated high frequency spectrum tonal components can be maintained only when the estimation of a harmonic frequency is accurate. Therefore, in order to improve the accuracy of the estimation, the correction of spectral peaks constituting the tonal components is performed before estimating the harmonic frequency.

Advantageous Effects of Invention

According to the present invention, it is possible to accurately replicate the tonal component in the high frequency spectrum, reconstructed by bandwidth extension for an input signal with harmonic structure, and to efficiently obtain good sound quality at low bitrate.

DESCRIPTION OF EMBODIMENTS

The main principle of the present invention is described in this section using FIGS. 3 to 14. Those skilled in the art will be able to modify or adapt the present invention without, deviating from the spirit of the invention.

Embodiment 1

Figure 1:
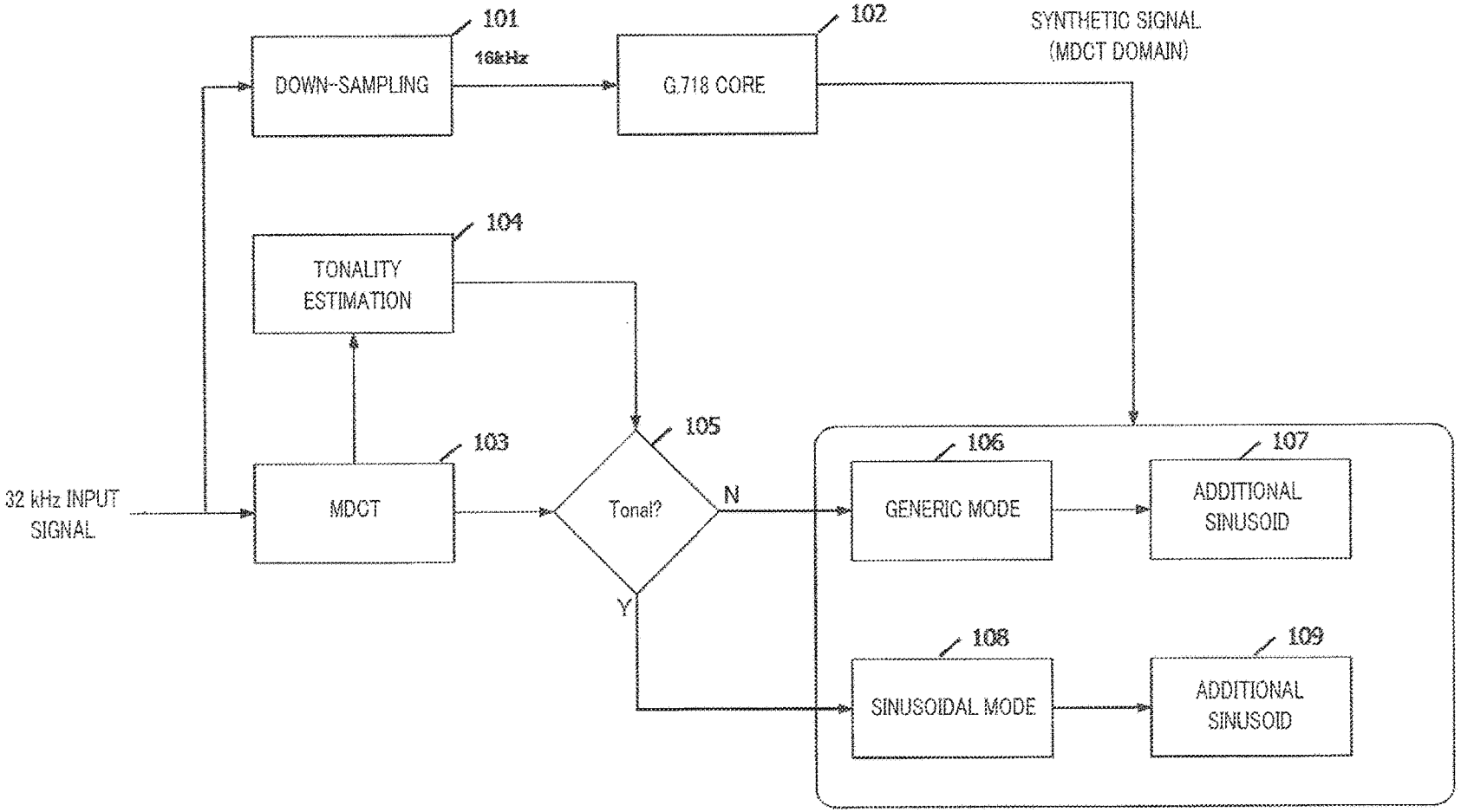
FIG. 1 illustrates the configuration of a G.718-SWB encoding apparatus.
Figure 2:
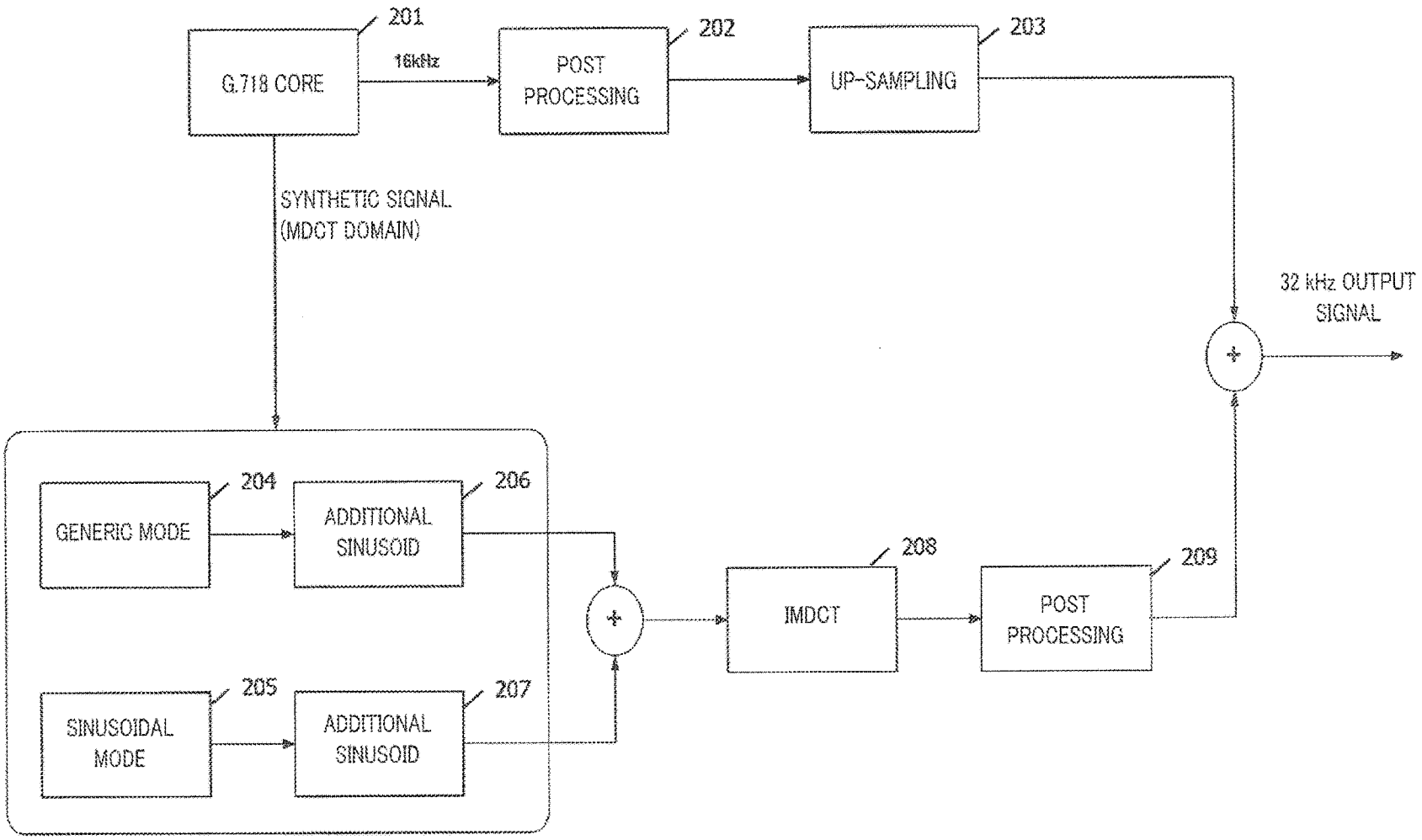
FIG. 2 illustrates the configuration of a G.718-SWB decoding apparatus.
Figure 3:
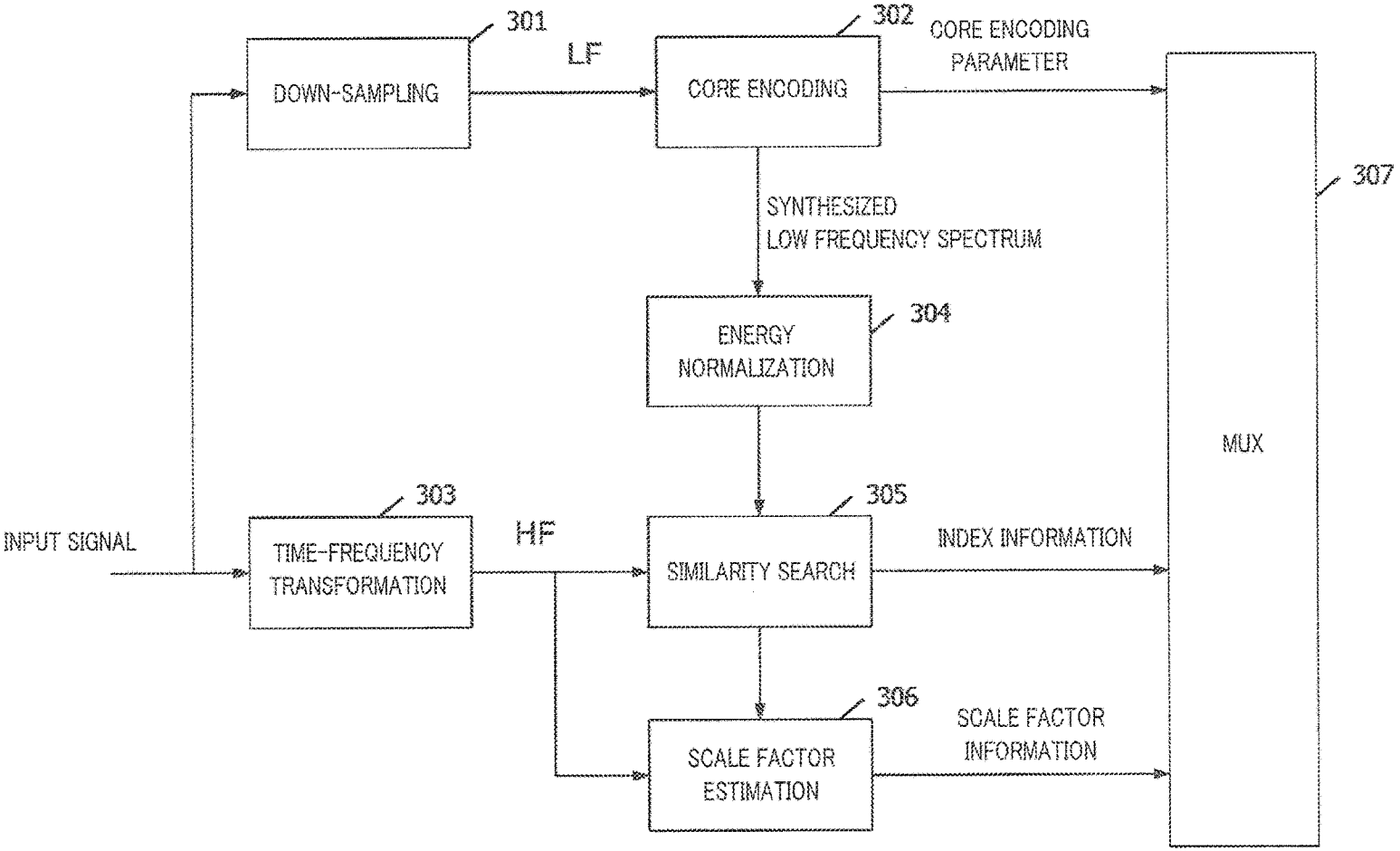
FIG. 3 is a block diagram illustrating the configuration of an encoding apparatus according to Embodiment 1 of the present invention.
Figure 4:
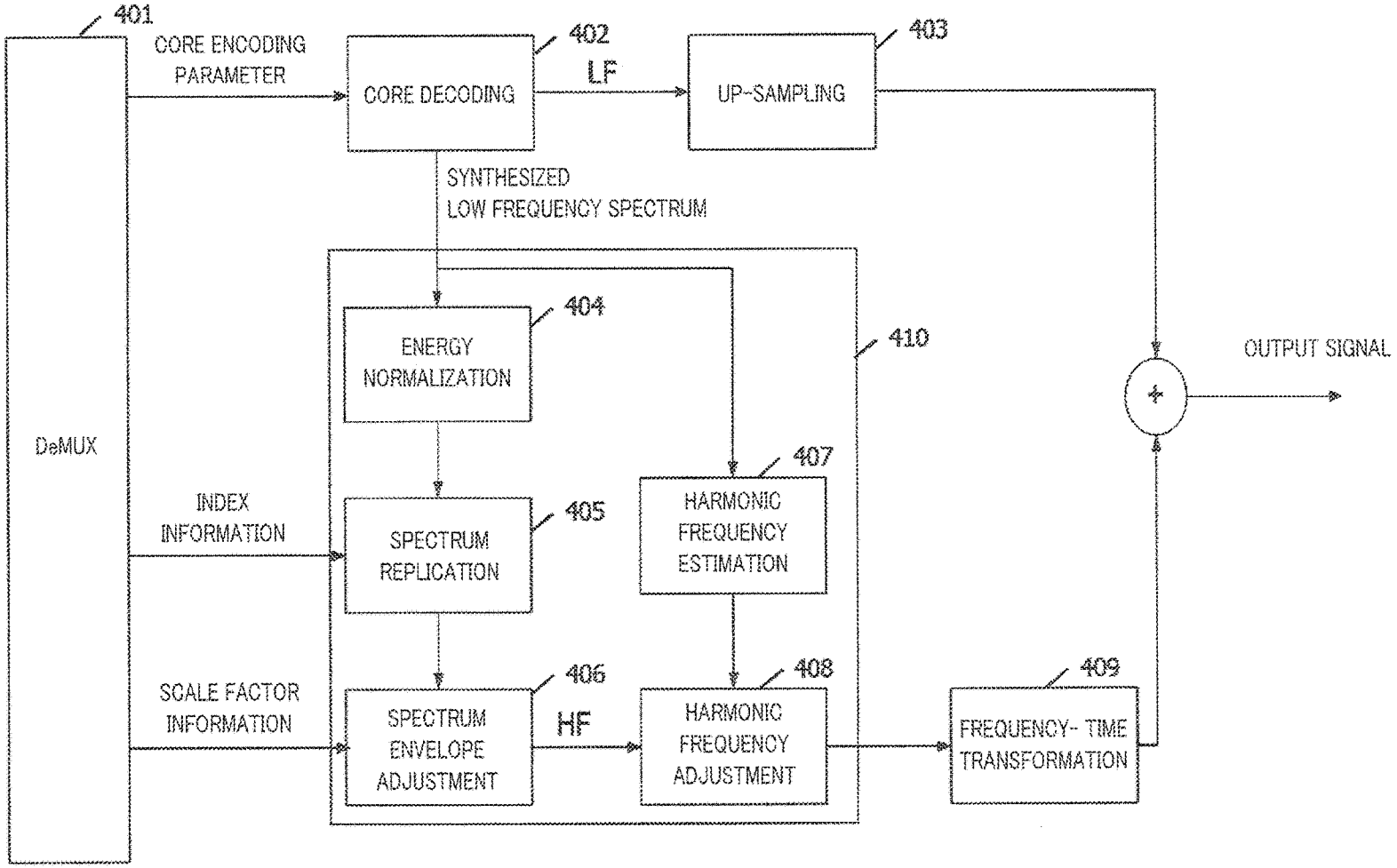
FIG. 4 is a block diagram illustrating the configuration of a decoding apparatus according to Embodiment 1 of the present invention.

The configuration of a codec according to the present invention is illustrated in FIGS. 3 and 4.

At an encoding apparatus side illustrated in FIG. 3, a sampled, input signal is firstly down-sampled (301). The down-sampled, low frequency band signal (low frequency signal) is encoded by a core encoding section (302). Core encoding parameters are sent to a multiplexer (307) to form a bitstream. The input signal is transformed to a frequency domain signal using a time-frequency (T/F) transformation section (303), and its high frequency band signal (high frequency signal) is split into a plurality of subbands. The encoding section may be an existing narrow band or wide band audio or speech codec, and one example is G718. The core encoding section (302) not only performs encoding but also has a local decoding section and a time-frequency transformation section to perform local decoding and time-frequency transformation of the decoded signal (synthesized signal) to supply the synthesized low frequency signal to an energy normalization section (304). The synthesized low frequency signal of the normalised frequency domain is utilized for the bandwidth, extension as follows. Firstly, a similarity search section (305) identifies a portion which is the most correlated with each subband of the high frequency signal of the input signal, using the normalized synthesized low frequency signal, and sends the index information as search results to a multiplexing section (307). Next, the information of scale factors between the most, correlated portion and each subband of the high frequency signal of the input signal is estimated (306), and encoded scale factor information is sent to the multiplexing section (307).

Finally, the multiplexing section (307) integrates the core, encoding parameters, the index information and the scale factor information into a bitstream.

In a decoding apparatus illustrated in FIG. 4, a demultiplexing section (401) unpacks the bitstream to obtain the core encoding parameters, the index information and the scale factor information.

A core decoding section reconstructs synthesized low frequency signals using the core encoding parameters (402). The synthesized low frequency signal is up-sampled (403), and used for bandwidth extension (410).

This bandwidth extension is performed as follows. That is, the synthesized low frequency signal is energy-normalized (404), and a low frequency signal identified according to the index information that identifies a portion which is the most correlated with each subband of the high frequency signal of the input signal derived at the encoding apparatus side is copied into the high frequency band (405), and the energy level is adjusted according to the scale factor information to achieve the same level of the energy level of the high frequency signal of the input signal (406).

Further, a harmonic frequency is estimated from the synthesized low frequency spectrum (407). The estimated harmonic frequency is used to adjust the frequency of the tonal component in the high frequency signal spectrum (408).

The reconstructed high frequency signal is transformed from a frequency domain to a time domain (409), and is added to the up-sampled synthesized low frequency signal to generate an output signal in the time domain.

The detail processing of a harmonic frequency estimation scheme will be described as follows:

1) From the synthesized low frequency signal (LF) spectrum, a portion for estimating a harmonic frequency is selected. The selected portion should have clear harmonic structure so that the harmonic frequency estimated from, the selected portion, is reliable. Usually, for every harmonic, a clear harmonic structure is observed from 1 to 2 kHz to around a cut-off frequency.
2) The selected portion is split into a multiplicity of blocks with a width near to a human's voice pitch frequency (about 100 to 400 Hz).
3) Spectral peaks, which are the spectrumwhoss amplitude is the maximum within each block, and spectral peak frequencies, which are the frequencies of those spectral peaks, are searched.
4) Post-processing is performed to the identified spectral peaks in order to avoid errors or to improve the accuracy in the harmonic frequency estimation.

Figure 5:
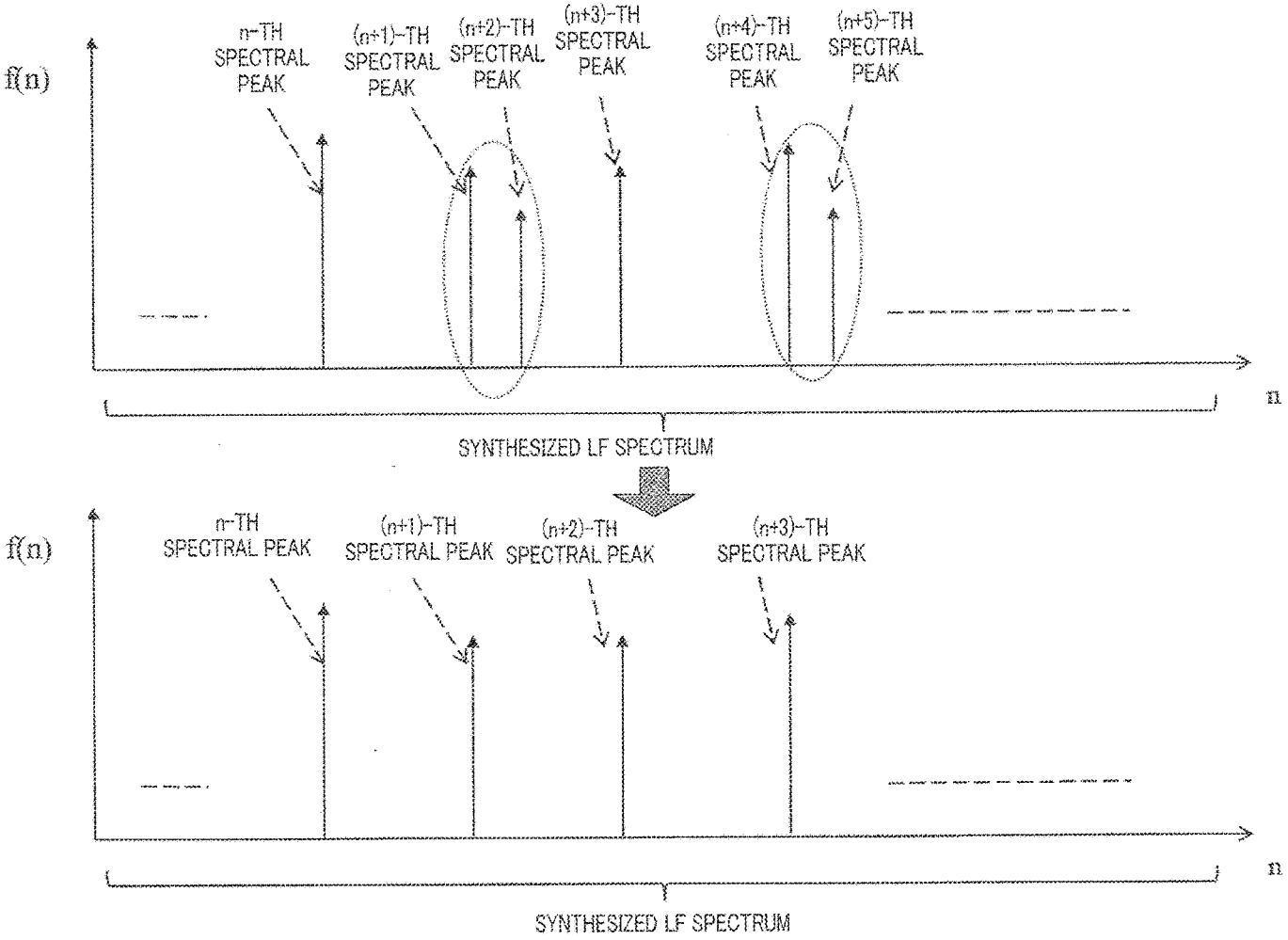
FIG. 5 is a diagram illustrating an approach for correcting the spectral peak detection.

The spectrum illustrated in FIG. 5 is used to describe an example of the post-processing.

Based on the synthesized low frequency signal spectrum, spectral peaks and spectral peak frequencies are calculated. However, a spectral peak with a small amplitude and extremely short spacing of a spectral peak frequency with respect to an adjacent spectral peak is discarded, which avoids estimation errors in calculating a harmonic frequency value.

1) The spacing between the identified spectral peak frequencies is calculated.
2) A harmonic frequency is estimated based on the spacing between the identified spectral peak frequencies. One of the methods for estimating the harmonic frequency is presented as follows:

(Equation 1)

$$\text{Spacing}_{peak}(n) = Pos_{peak}(n+1) - Pos_{peak}(n), \quad n \in [1, N-1] \qquad [1]$$

$$Est_{Harmonic} = \frac{\sum_{n=1}^{N-1} \text{Spacing}_{peak}(n)}{N-1}$$

where $Est_{Harmonic}$ is the calculated harmonic frequency;

$\text{Spacing}_{peak}$ is the frequency spacing between the detected peak positions:

N is the number of the detected peak positions;

$Pos_{peak}$ is the position of the detected peak;

The harmonic frequency estimation is also performed according to a method described as follows:

1) In the synthesized low frequency signal (LF) spectrum, in order to estimate a harmonic frequency, a portion having a clear harmonic structure is selected so that the estimated harmonic frequency is reliable. Usually, for every harmonic, a clear harmonic structure can be seen from 1 to 2 kHz to around a cut-off frequency.
2) A spectrum and its frequency having the maximum amplitude (absolute value) are identified within the selected portion of the above-mentioned synthesized low frequency signal (spectrum).
3) A set of spectral peaks having a substantially equal frequency spacing from the spectrum frequency of the spectrum with the maximum amplitude and at which the absolute value of the amplitude exceeds a predetermined threshold is identified. As the predetermined threshold, it is possible to apply for example, a value twice the standard deviation of the spectral amplitudes contained in the above-mentioned selected portion.
4) The spacing between the above-mentioned spectral peak frequencies is calculated,
5) The harmonic frequency is estimated based on the spacing between the above-mentioned spectral peak frequencies. Also in this case, the method in Equation (1) can be used to estimate the harmonic frequency.

There is a case where the harmonic component in the synthesized low frequency signal spectrum is not well encoded, at a very low bitrate. In this case, there is a possibility that some of the spectral peaks identified may not correspond to the harmonic components of the input signals at all. Therefore, in the calculation of the harmonic frequency, the spacing between spectral peak frequencies which are largely different from the average value should be excluded from the calculation target.

Also, there is a case where not all the harmonic components can be encoded (meaning that some of the harmonic components are missing in the synthesized low frequency signal spectrum) due to the relatively low amplitude of the spectral peak, the bitrate constraints for encoding, or the like. In these cases, the spacing between the spectral peak frequencies extracted at the missing harmonic portion is considered to be twice or a few times the spacing between the spectral peak frequencies extracted at the portion which retains good harmonic structure. In this case, the average value of the extracted values of the spacing between the spectral peak frequencies where the values are included in the predetermined range including the maximum spacing between the spectral peak frequencies is defined as an estimated harmonic frequency value. Thus, it becomes possible to properly replicate the high frequency spectrum. The specific procedure comprises the following steps:

1) The minimum and maximum values of the spacing between the spectral peak frequencies are identified;

[2]

$$\text{Spacing}_{peak}(n) = \text{Pos}_{peak}(n+1) - \text{Pos}_{peak}(n),\ n \in [1, N-1]$$

$$\text{Spacing}_{min} = (\{\text{Spacing}_{peak}(n)\});$$

$$\text{Spacing}_{max} = \max(\{\text{Spacing}_{peak}(n)\}); \qquad \text{(Equation 2)}$$

where;

$Spacing_{peak}$ is the frequency spacing between the detected peak positions;

$Spacing_{min}$ is the minimum frequency spacing between the detected peak, positions;

$Spacing_{max}$ is the maximum frequency spacing between the detected peak positions;

N is the number of the detected peak positions;

$Pos_{peak}$ is the position of the detected peak;

2) Every spacing between spectral peak frequencies is identified in the range of:

[3]

$[k*Spacing_{min}, Spacing_{max}], k \in [1,2]$

3) The average value of the identified spacing values between the spectral peak frequencies in the above range is defined as the estimated harmonic frequency value, Next, one example of harmonic frequency adjustment schemes will be described below.

1) The last encoded spectral peak and its spectral peak frequency are identified in the synthesized low frequency signal (LF) spectrum.

2) The spectral peak and the spectral, peak frequency are identified within the high frequency spectrum replicated by bandwidth extension.

Figure 6:
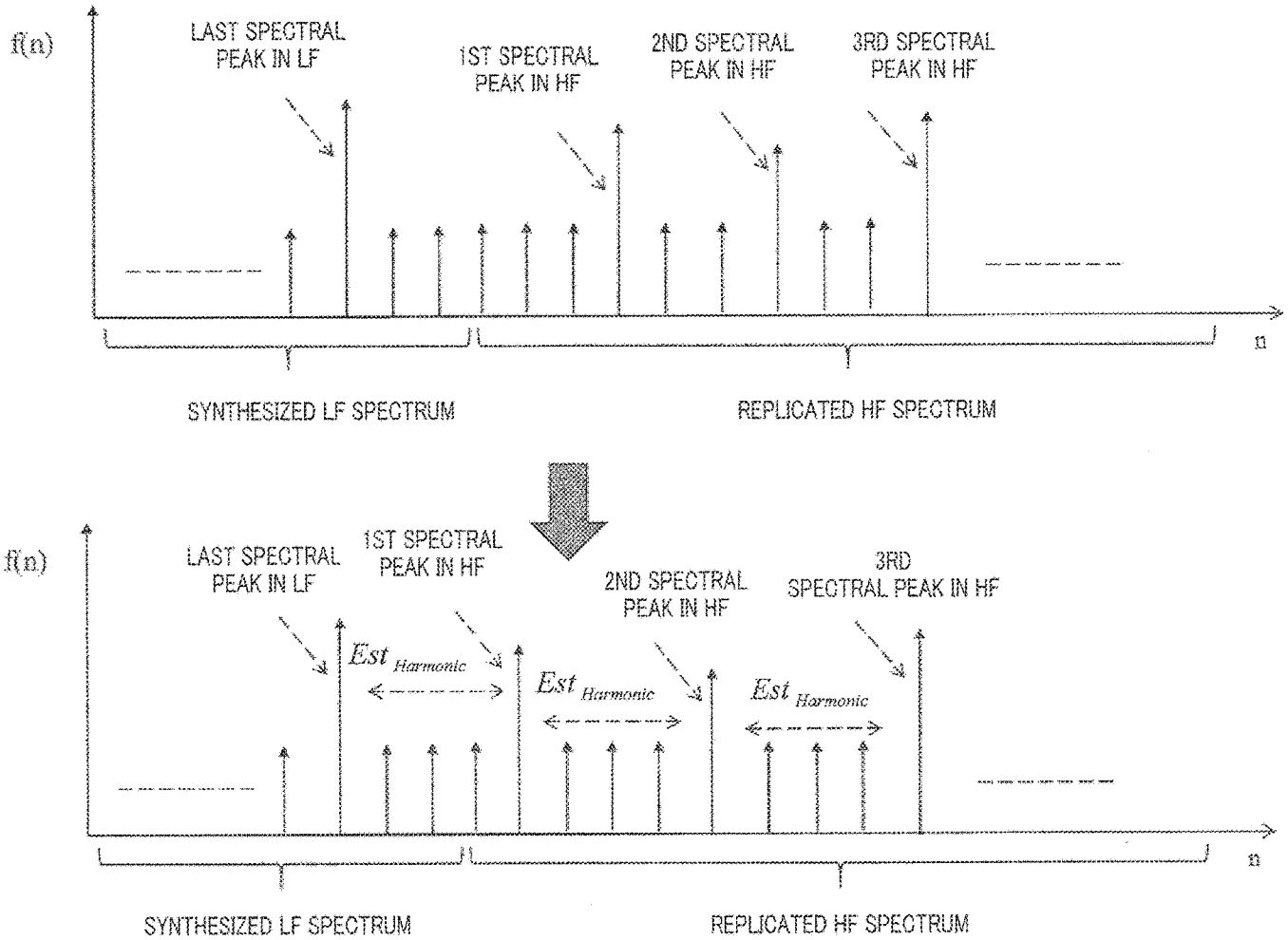
FIG. 6 is a diagram illustrating an example of a harmonic frequency adjustment method.

3) Using the highest spectral peak frequency as a reference, among spectral peaks of the synthesized tow frequency signal spectrum, the spectral peak frequencies are adjusted so that the values of the spacing between, the spectral peak frequencies are equal to the estimated value of the spacing between the harmonic frequencies. This processing is illustrated in FIG. 6. As illustrated in FIG. 6, firstly, the highest spectral peak frequency in the synthesized low frequency signal spectrum and the spectral peaks in fee replicated high frequency spectrum are identified. Then, the lowest spectral peak frequency in the replicated high frequency spectrum is shifted to the frequency having a spacing of $Est_{Harmanic}$ from the highest spectral peak frequency of the synthesized low frequency signal spectrum. The second lowest spectral peak frequency in the replicated high frequency spectrum is shifted to the frequency having a spacing of $Est_{Harmonic}$ from the above-mentioned shifted lowest spectral peak frequency. The processing is repeated until such an adjustment is completed for every spectral, peak frequency of the spectral peak in the replicated high frequency spectrum.

Harmonic frequency adjustment schemes as described below are also possible.

Figure 7:
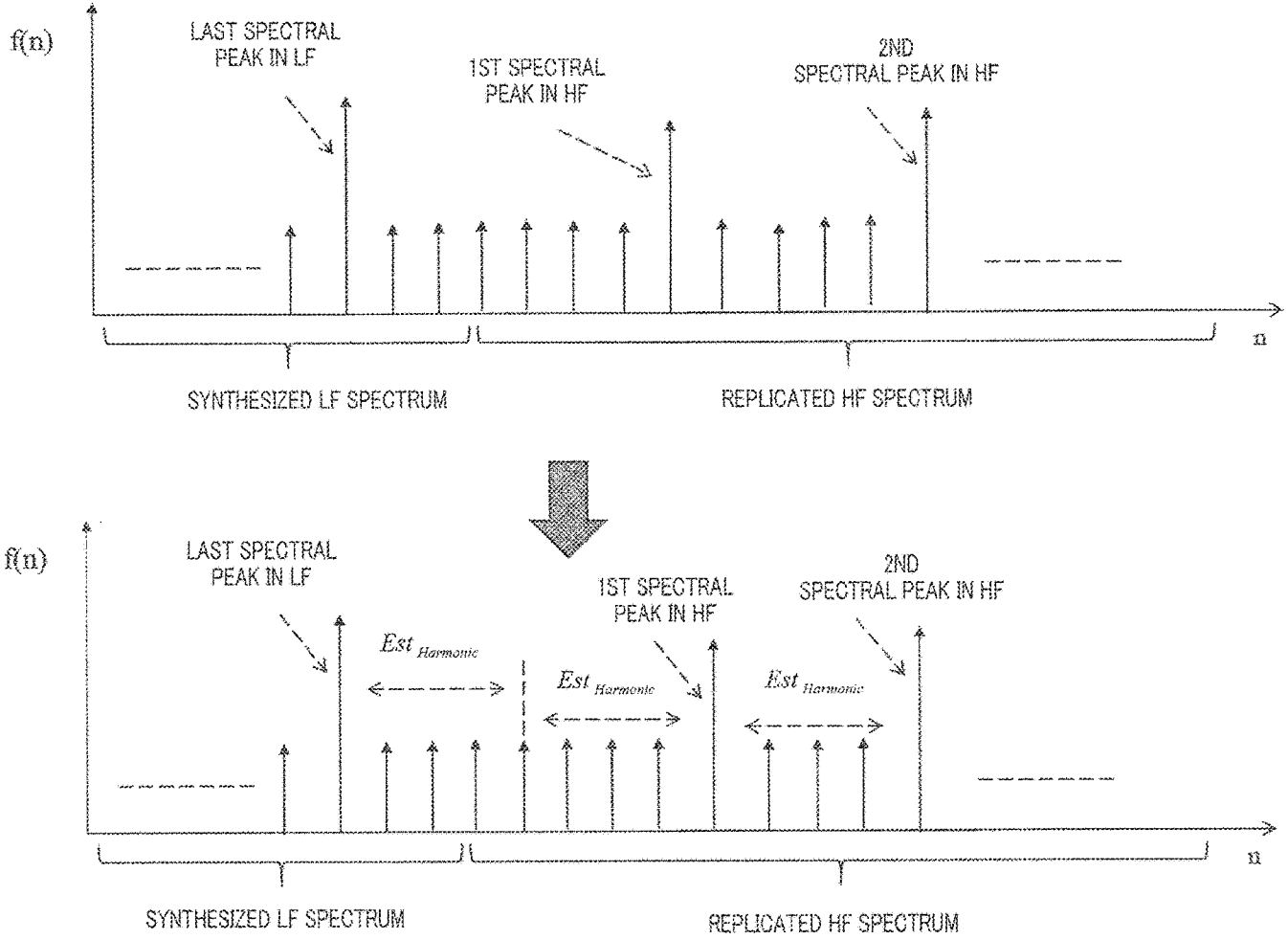
FIG. 7 is a diagram illustrating another example of a harmonic frequency adjustment method.

1) The synthesized low frequency signal (LF) spectrum having the highest spectral peak frequency is identified.
2) The spectral peak and the spectral peak frequency within the high frequency (HF) spectrum extended in terms of bandwidth by bandwidth extension are identified.
3) Using the highest spectral peak frequency of the synthesized low frequency signal spectrum as a reference, possible spectral peak frequencies in the HR spectrum are calculated. Each spectral peak in the high frequency spectrum replicated by the bandwidth extension is shifted to a frequency which is the closest to each spectral peak frequency, among the calculated spectral peak frequencies. This processing is illustrated in FIG. 7. As illustrated in FIG. 7, firstly, the synthesized low frequency spectrum having the highest spectral peak frequency and the spectral peaks in the replicated high frequency spectrum are extracted. Then, possible spectral peak frequency in the replicated high frequency spectrum is calculated. The frequency having a spacing of $Est_{Harmonic}$ from the highest spectral peak frequency of the synthesized low frequency signal spectrum is defined as a spectral peak frequency which may be the first spectral peak frequency in the replicated high frequency spectrum. Next, the frequency having a spacing of $Est_{Harmonic}$ from the above-mentioned spectral peak frequency which may be the first spectral peak frequency is defined as a spectral peak frequency which may be the second spectral peak frequency. The processing is repeated as long as the calculation is possible in the high frequency spectrum.

Thereafter, the spectral peak extracted in the replicated high frequency spectrum is shifted to frequency which is the closest to the spectral peak frequency, among the possible spectral peak frequencies calculated as described above.

There is also a case where the estimated harmonic value $Est_{Harmonic}$ does not correspond to an integer frequency bin. In this case, the spectral peak frequency is selected to be a frequency bin which is the closest to the frequency derived based on $Est_{Harmonic}$.

There also may be a method of estimating a harmonic frequency in which the previous frame spectrum is utilized to estimate the harmonic frequency, and a method of adjusting the frequencies of tonal components in which the previous frame spectrum is takers into consideration so that the transition between frames is smooth when adjusting the tonal component. It is also possible to adjust the amplitude such that, even when the frequencies of the tonal components are shifted, the energy level of the original spectrum is maintained. All such minor variations are within the scope of the present invention.

The above descriptions are ail given as examples, and the ideas of the present invention are not limited by the given examples. Those skilled in the art will be able to modify and adapt the present invention without deviating from the spirit of the invention.

[Effect]

The bandwidth extension method according to the present invention replicates the high frequency spectrum utilizing the synthesized low frequency signal spectrum which is the most correlated with the high frequency spectrum, and shifts the spectral peaks to the estimated harmonic frequencies. Thus, it becomes possible to maintain both the fine structure of the spectrum and the harmonic structure between the low frequency band spectral peaks and the replicated high frequency band spectral peaks.

Embodiment 2

Figure 8:
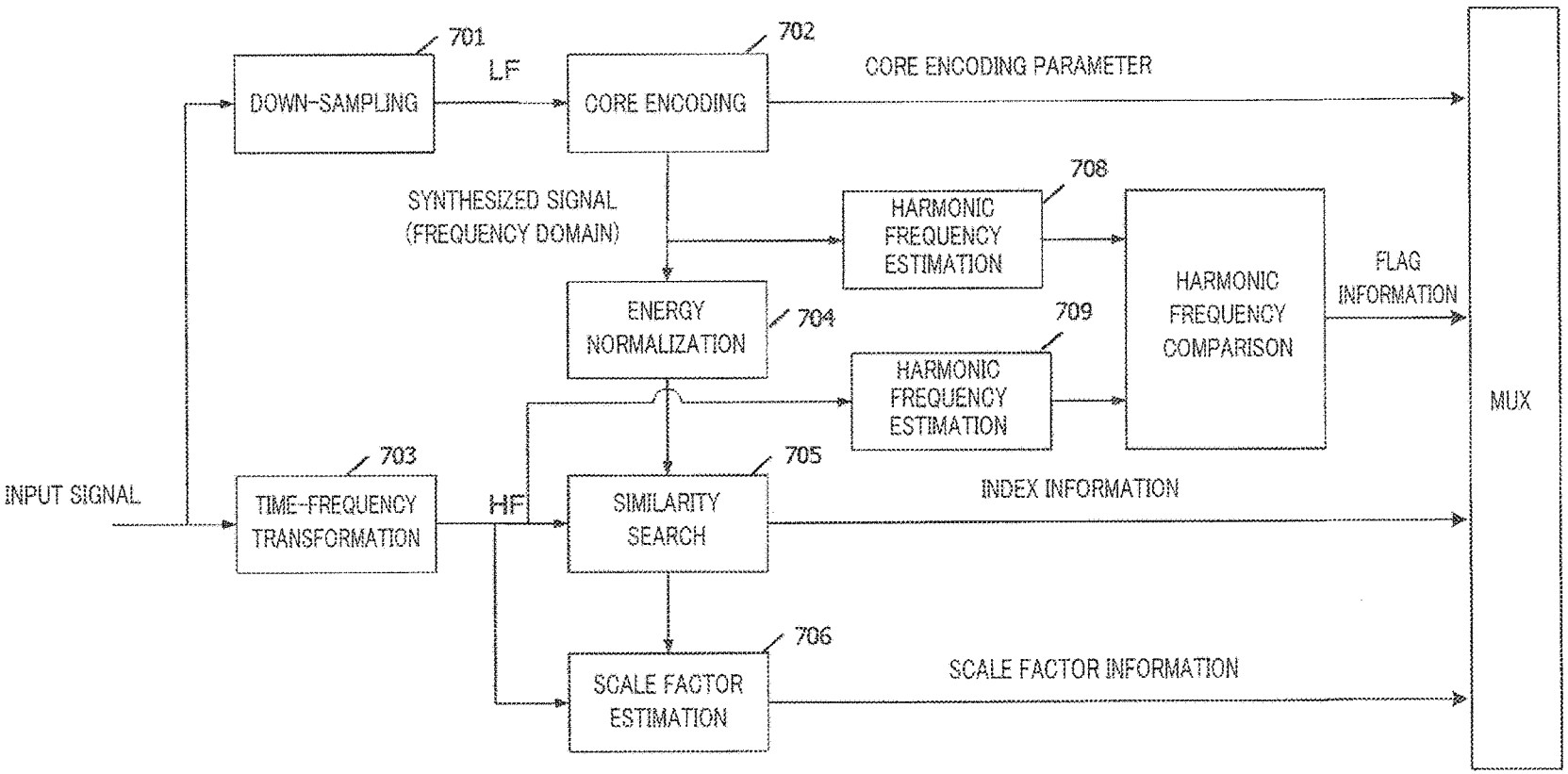
FIG. 8 is a block diagram illustrating the configuration of an encoding apparatus according to Embodiment 2 of the present invention.
Figure 9:
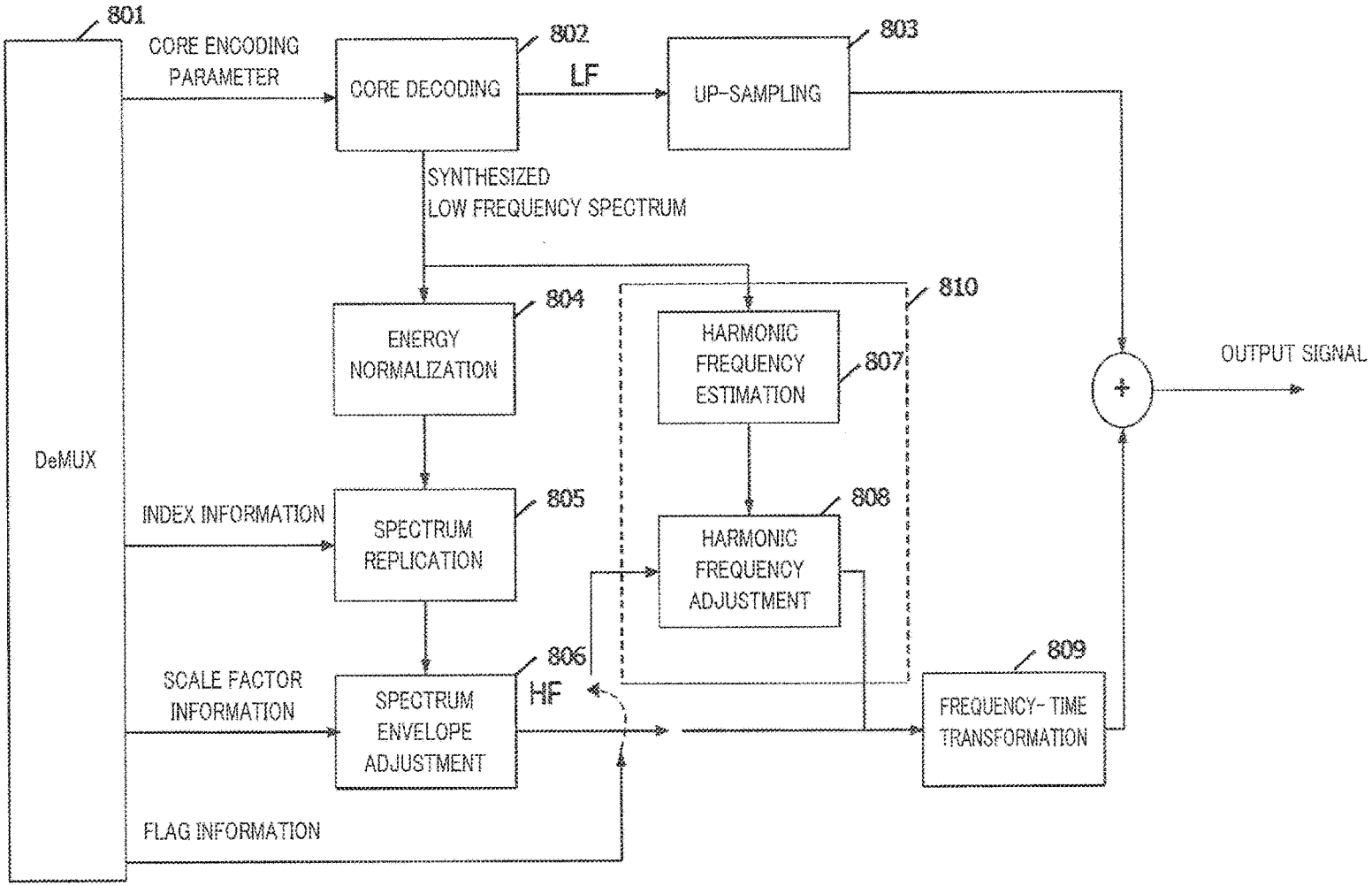
FIG. 9 is a block diagram illustrating the configuration of a decoding apparatus according to Embodiment 2 of the present invention.

Embodiment 2 of the present invention is illustrated in FIGS. 8 and 9.

The encoding apparatus according to Embodiment 2 is substantially the same as that of Embodiment 1, except harmonic frequency estimation sections (708 and 709) and a harmonic frequency comparison section (710).

The harmonic frequency is estimated separately from synthesized low frequency spectrum (708) and high frequency spectrum (709) of the input signal, and flag information is transmitted based on the comparison result between the estimated values of those (710). As one of the examples, the flag information can be derived as in the following equation:

if $$Est_{Harmonic_LF} \in [Est_{Harmonic_HF} - Threshold, Est_{Harmonic_HF} + Threshold] \quad [4]$$

Flag−1

Otherwise

Flag=0 (Equation 3)

where $Est_{Harmonic_LF}$ is the estimated harmonic frequency from the synthesized low frequency spectrum;

$Estr_{Harmonic_HF}$ is the estimated harmonic frequency from the original high frequency spectrum;

Threshold is a predetermined threshold for the difference between $Est_{Harmonic_LF}$ and $Est_{Harmonic_HF}$;

Flag is the flag signal to Indicate whether the harmonic adjustment should be applied;

That is, the harmonic frequency estimated from the synthesized low frequency signal spectrum (synthesized low frequency spectrum) $Est_{Harmonic_HF}$ is compared with the harmonic frequency estimated from the high frequency spectrum of the input signal $Est_{Harmonic_HF}$. When the difference between the two values is small enough, it is considered that the estimation from the synthesized low frequency spectrum is accurate enough, and a flag (Flag−1) meaning that it may be used for harmonic frequency adjustment is set. On the other hand, when the difference between the two values is not small, it is considered that the estimated value from the synthesized low frequency spectrum is not accurate, and a flag (Flag=0) meaning that it should not be used for harmonic frequency adjustment is set.

At decoding apparatus side illustrated in FIG. 9, the value of the flag information determines whether or not the harmonic frequency adjustment (810) is applied to the replicated high frequency spectrum. That is, in the case of Flag=1, the decoding apparatus performs harmonic frequency adjustment, whereas in the case of Flag=0, it does not perform harmonic frequency adjustment.

[Effect]

For several input signals, there is a ease where the harmonic frequency estimated from the synthesized low frequency spectrum is different from the harmonic frequency of the high frequency spectrum of the input signal. Especially at low bitrate, the harmonic structure of the low frequency spectrum is not well maintained. By sending the flag information, it becomes possible to avoid the adjustment of the tonal component using a wrongly estimated value of the harmonic frequency.

Embodiment 3

Figure 10:
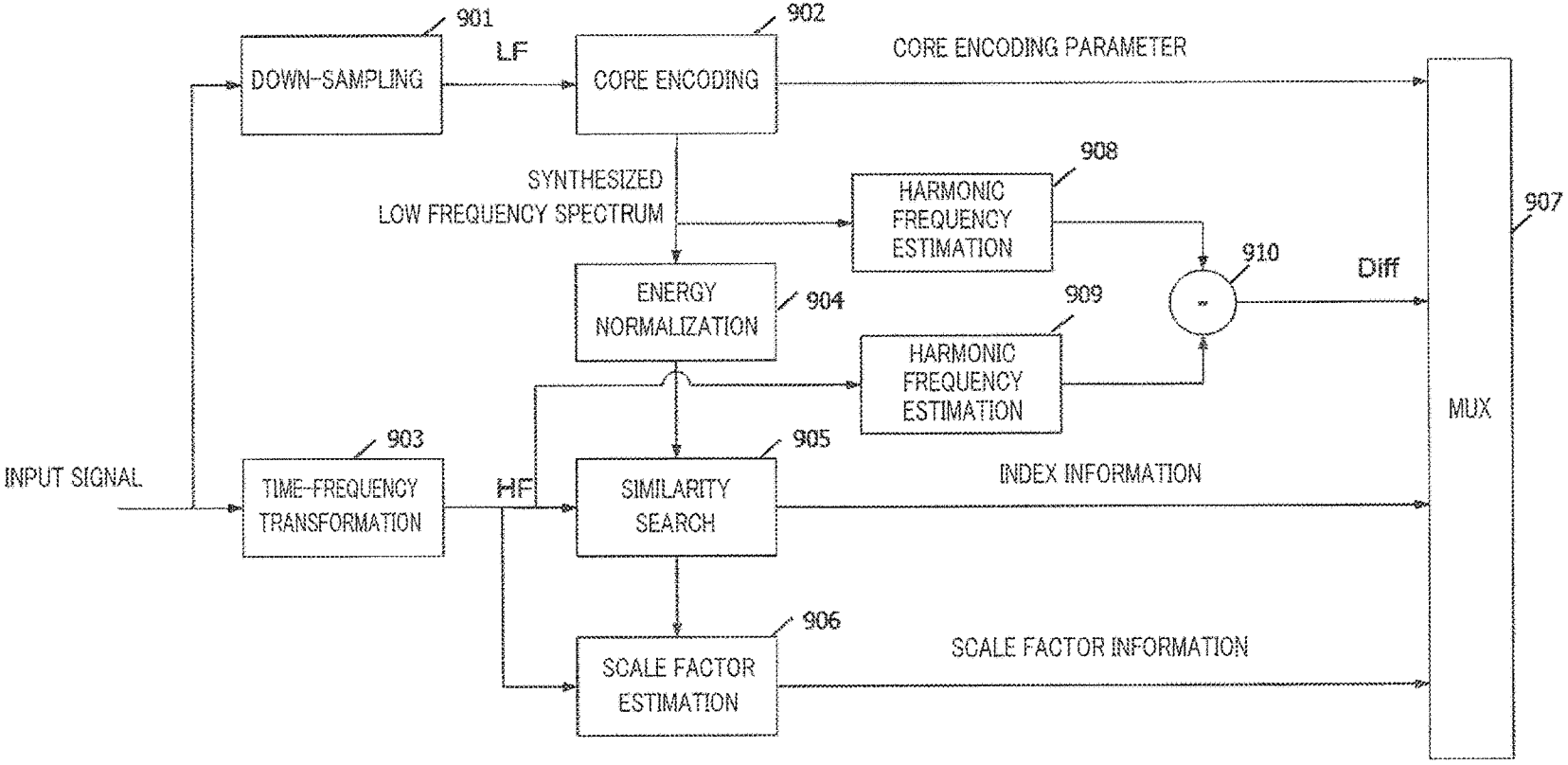
FIG. 10 is a block diagram illustrating the configuration of an encoding apparatus according to Embodiment 3 of the present invention.
Figure 11:
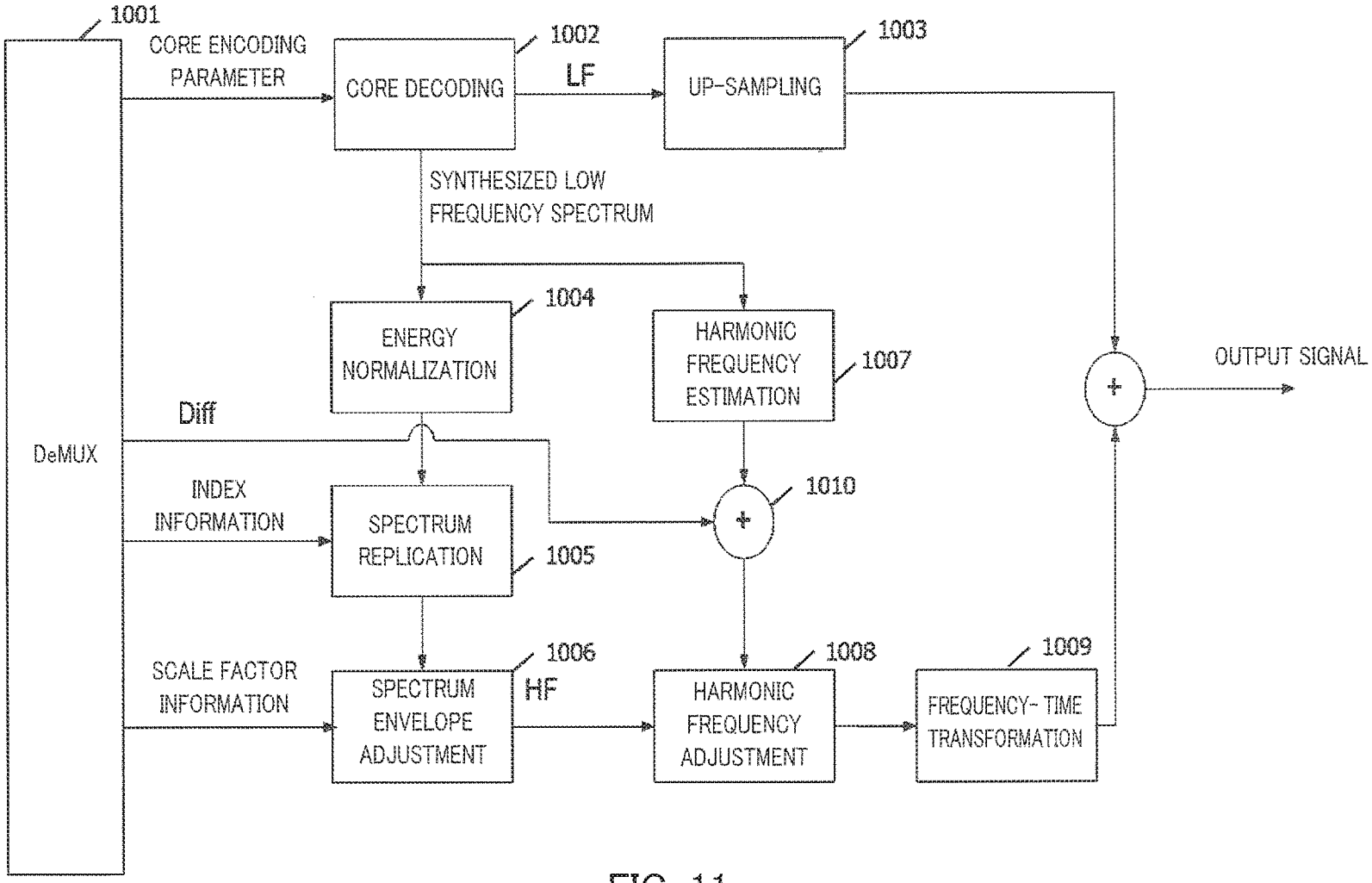
FIG. 11 is a block diagram illustrating the configuration of a decoding apparatus according to Embodiment 3 of the present invention.

Embodiment 3 of the present invention is illustrated in FIGS. 10 and 11.

The encoding apparatus according to Embodiment 3 is substantially the same as that of Embodiment 2, except differential device (910).

The harmonic frequency is estimated separately from the synthesized low frequency spectrum (908) and high frequency spectrum (909) of the input signal. The difference between the two estimated harmonic frequencies (Diff) is calculated (910), and transmitted to the decoding apparatus side.

At decoding apparatus side illustrated in FIG. 11, the difference value (Diff) is added to the estimated value of the harmonic frequency from the synthesized low frequency spectrum (1010), and the newly calculated value of the harmonic frequency is used for the harmonic frequency adjustment in the replicated high frequency spectrum.

Instead of the difference value, the harmonic frequency estimated from the high frequency spectrum of the input signal may also be directly transmitted to the decoding section. Then, the received harmonic frequency value of the high frequency spectrum of the input signal is used to perform the harmonic frequency adjustment. Thus, it becomes unnecessary to estimate the harmonic frequency from the synthesized low frequency spectrum at the decoding apparatus side.

[Effect]

There is a case where, for several signals, the harmonic frequency estimated from the synthesized low frequency spectrum is different from the harmonic frequency of the high frequency spectrum of the input signal. Therefore, by sending the difference value, or the harmonic frequency value derived from the high frequency spectrum of the input signal, it becomes possible to adjust the tonal, component of the high frequency spectrum replicated through bandwidth extension by the decoding apparatus at the receiving side more accurately.

Embodiment 4

Figure 12:
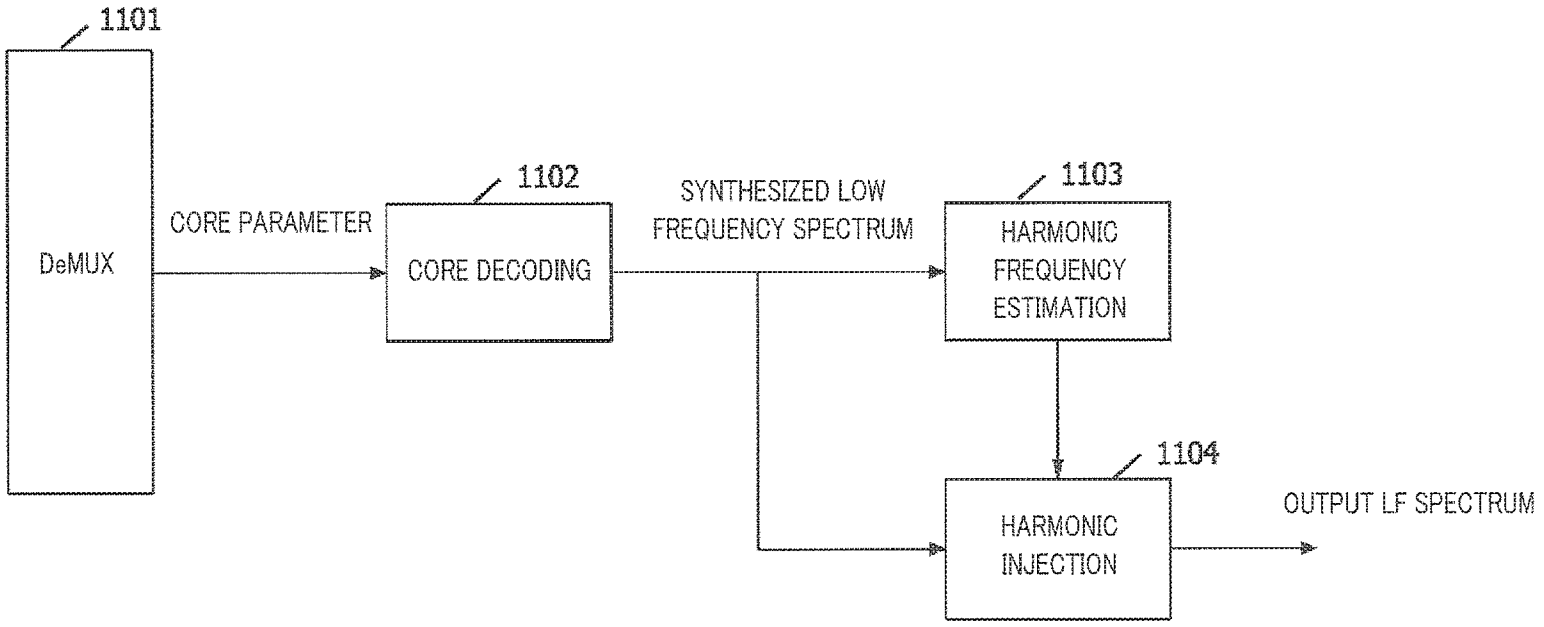
FIG. 12 is a block diagram illustrating the configuration of a decoding apparatus according to Embodiment 4 of the present invention.

Embodiment 4 of the present invention is illustrated in FIG. 12.

The encoding apparatus according to Embodiment 4 is the same as any other conventional encoding apparatuses, or is the same as the encoding apparatus in Embodiment 1, 2 or 3.

At decoding apparatus side illustrated in FIG. 12, the harmonic frequency is estimated from the synthesized low frequency spectrum (1103). The estimated value of this harmonic frequency is used for harmonic injection (1104) in the low frequency spectrum.

Especially when the available bitrate is low, there is a case where some of the harmonic components of the low frequency spectrum are hardly encoded, or are not encoded at all. In this case, the estimated harmonic frequency value can be used to inject the missing harmonic components.

Figure 13:
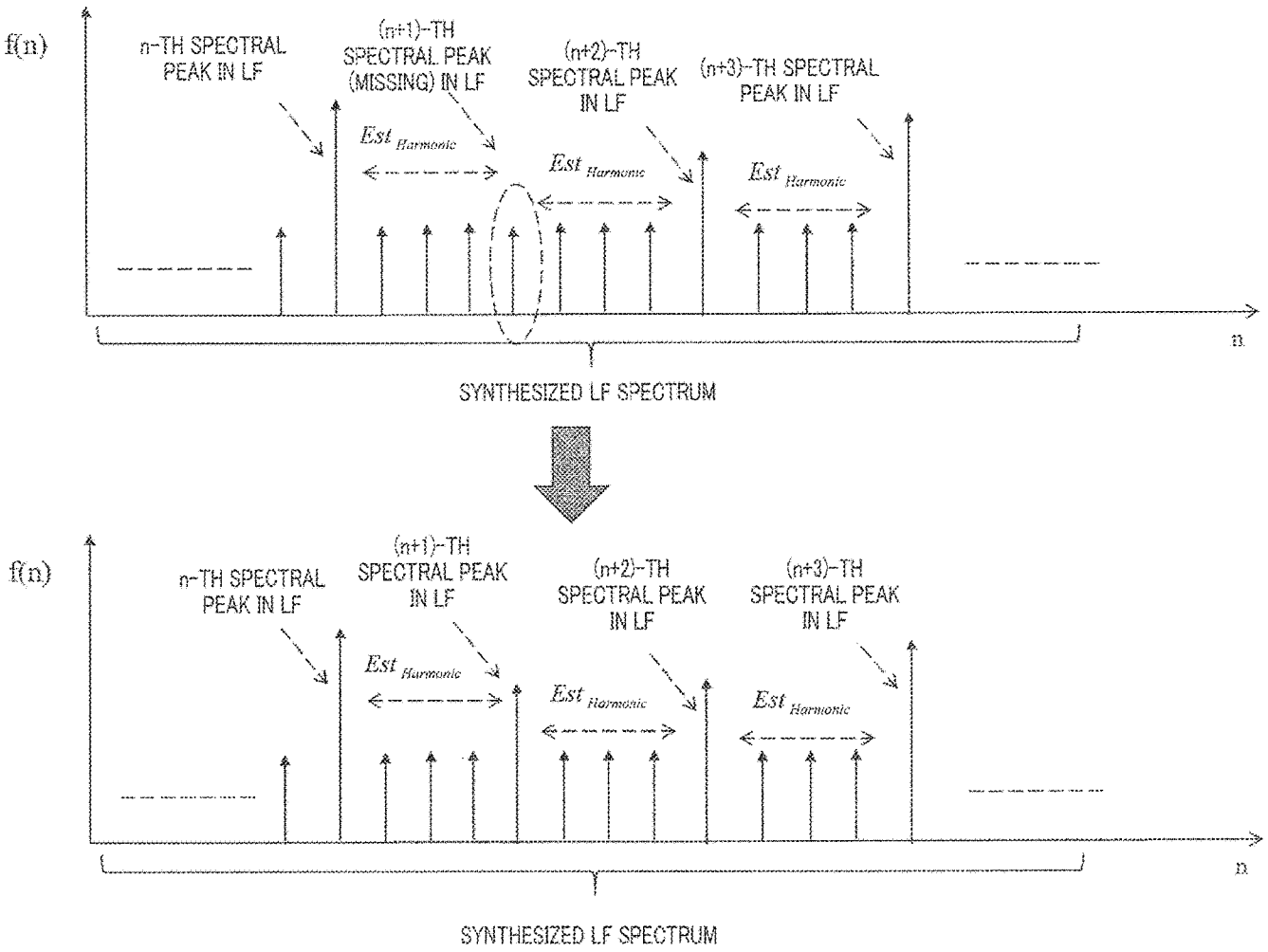
FIG. 13 is a diagram illustrating an example of a harmonic frequency adjustment method for a synthesized low frequency spectrum.
Figure 14:
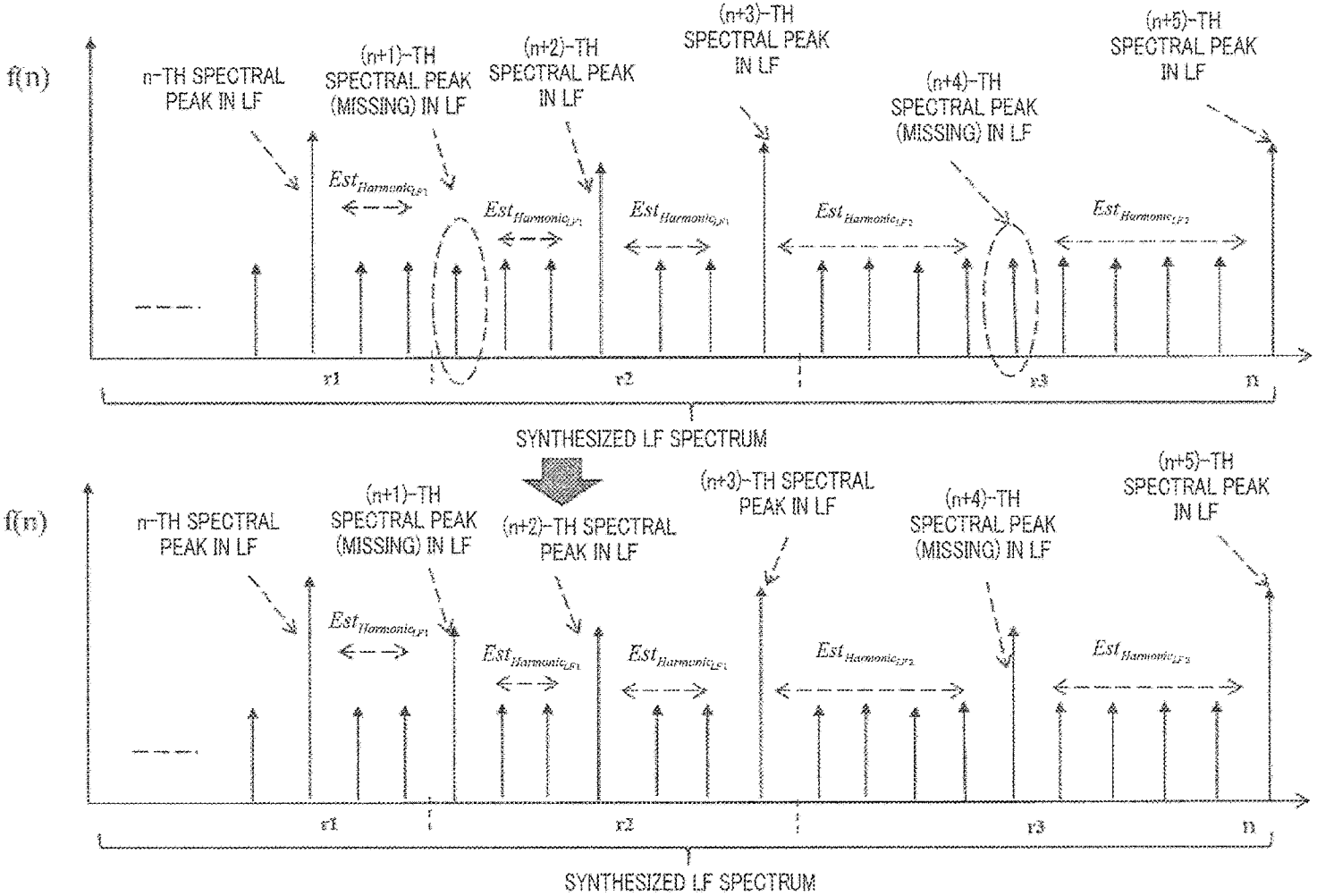
FIG. 14 is a diagram illustrating an example of an approach for injecting missing harmonics into the synthesized low frequency spectrum.

This will be illustrated in the FIG. 13. It can be seen, from FIG. 13, that there is a missing harmonic component in the synthesized low frequency (LF) spectrum. Its frequency can be derived using the estimated harmonic frequency value. Further, as for its amplitude, for example, it is possible to use the average value of the amplitudes of other existing spectral peaks or the average value of the amplitudes of the existing spectral peaks neighboring to the missing harmonic component on the frequency axis. The harmonic component generated according to the frequency and amplitude is injected for restoring the missing harmonic component.

Another approach for injecting the missing harmonic component will be described as follows:

1. The harmonic frequency is estimated using the encoded LF spectrum (1103).

1.1 The harmonic frequency is estimated using spacing between spectral peak frequencies identified in the encoded low frequency spectrum.

1.2 The values of spacing between the spectral peak frequencies, which are derived, from the missing harmonic portion, become twice or a few times of values of the spacing between the spectral peak frequencies, which are derived from a portion which has a good harmonic structure. Such values of the spacing between the spectral peak frequencies are grouped into different categories, and the average spacing value between the spectral peak frequencies is estimated for each of the categories. The detail thereof will be described as follows:

a. The minimum value and the maximum value of the spacing value between the spectral peak frequencies are identified.

[5]

$Spacing_{peak}(n)=Pos_{peak}(n+1)-Pos_{peak}(n),\ n\in[1,N-1]$ $Spacing_{min}=\min(\{Spacing_{peak}(n)\});$ $$Spacing_{max}=\max(\{Spacing_{peak}(n)\}); \quad \text{(Equation 4)}$$

where;

$Spacing_{peak}$ is the frequency spacing between the detected peak positions;

$Spacing_{min}$ is the minimum frequency spacing between the detected peak positions;

$Spacing_{max}$ is the maximum frequency spacing between the detected peak positions;

N is the number of the detected peak positions;

$Pos_{peak}$ is the position of the detected peak;

b. Every spacing value is identified in the range of:

[6]

$r_1=[Spacing_{min},\ k*Spacing_{min})$ $r_2=[k*Spacing_{min}, Spacing_{max}],1<k\leq 2$ c. The average values of the spacing values identified in the above ranges are calculated as the estimated harmonic frequency values.

(Equation 5)

$$Est_{Harmonic_{LP1}}=\frac{\sum Spacing_{peak}(n)}{N_1},\ Spacing_{peak}(n)\in r_1 \quad [7]$$

$$Est_{Harmonic_{LP2}}=\frac{\sum Spacing_{peak}(n)}{N_2},\ Spacing_{peak}(n)\in r_2$$

where $Est_{Harmonic_{LF1}}$, $Est_{Harmonic_{LH2}}$ the estimated harmonic frequencies $N_1$ is the number of the detected peak positions belonging to $r_1$ $N_2$ is the number of the detected peak positions belonging to $r_2$ 2. Using the estimated harmonic frequency values, the missing harmonic components are injected.

2.1 The selected LF spectrum is split into several regions, 2.2 The missing harmonics are identified by utilizing region information and the estimated frequencies, For example, assume that the selected LF spectrum is split into three regions $r_1$, $r_2$, and $r_3$.

Based on the region information, the harmonics are identified and injected.

Due to the signal characteristics for harmonics, the spectral gap between harmonics is $Est_{Harmonic_{LF1}}$ in r1 and r2 regions, and is $Est_{Harmonic_{LF2}}$ in r3 region. This information can be used for extending the LF spectrum. This is illustrated further in FIG. 14. It can be seen, from FIG. 14, that there is a missing harmonic component in the domain $r_2$ of the LF spectrum. This frequency can be derived using the estimated harmonic frequency value $Est_{Harmonic_{LF1}}$.

Similarly, $Est_{Harmonic_{LF2}}$ is used for tracking and injecting the missing harmonic in region $r_3$.

Further, as for its amplitude, it is possible to use the average value of the amplitudes of all the harmonic components which are not missing or the average value of the amplitudes of the harmonic components preceding and following the missing harmonic component. Alternatively, as for the amplitude, a spectral peak with the minimum amplitude in the WB spectrum may be used. The harmonic component generated using the frequency and amplitude Is injected into the LF spectrum for restoring the missing harmonic component.

[Effect]

There is a case where the synthesized low frequency spectrum is not maintained for several signals. Especially at low bitrate, there is a possibility that several harmonic components may be missing. By injecting the missing harmonic components in the LF spectrum, it becomes possible not only to extend the LF, but also improve the harmonic characteristics of the reconstructed harmonics. This can suppress the auditory influence cue to missing harmonics to further improve the sound quality.

The disclosure of Japanese Patent. Application No. 2013-12, 2985 filed on Jun. 11, 2013, including the specification, drawings and abstract, is incorporated herein by reference in its entirety.

INDUSTRIAL APPLICABILITY

The encoding apparatus, decoding apparatus and encoding and decoding methods according to the present invention are applicable to a wireless communication terminal apparatus, base station apparatus in a mobile communication system, tele-conference terminal apparatus, video conference terminal apparatus, and voice over internet protocol (VOIP) terminal apparatus.

The invention claimed is:

1. An audio signal decoding apparatus comprising:

a demultiplexing section that takes out core encoding parameters, index information, and scale factor information from encoded information;

a core decoding section that decodes the core encoding parameters to obtain a synthesized low frequency spectrum;

a spectrum replication section that replicates a high frequency subband spectrum based on the index information using the synthesized low frequency spectrum; and a spectrum envelope adjustment section that adjusts an amplitude of the replicated high frequency subband spectrum using the scale factor information, the audio signal decoding apparatus generating an output signal using the synthesized low frequency spectrum and the high frequency subband spectrum, wherein the audio signal decoding apparatus further comprises:

a harmonic frequency estimation section that estimates a frequency of a harmonic component in the replicated high frequency subband spectrum; and a harmonic frequency adjustment section that adjusts a frequency of a harmonic component in a high frequency spectrum using the harmonic frequency estimated using the synthesized low frequency spectrum.

2. The audio signal decoding apparatus according to claim 1, wherein the harmonic frequency estimation section comprises:

a splitting section that that splits a preselected portion of the synthesized low frequency spectrum into a predetermined number of blocks;

a spectral peak identification section that determines a spectral peak having a maximum amplitude in each block and a frequency of the spectral peak;

a spacing calculation section that calculates spacing between the identified spectral peak frequencies; and a harmonic frequency calculation section that calculates the harmonic frequency using the spacing between the identified spectral peak frequencies.

3. The audio signal decoding apparatus according to claim 1, wherein the harmonic frequency estimation section comprises:

a spectral peak identification section that identifies a spectrum having a maximum absolute value of an amplitude at the preselected portion of the synthesized low frequency spectrum and a spectrum which is positioned at substantially equal spacing from the spectrum on a frequency axis and at which the absolute value of the amplitude is equal to or more than a predetermined threshold;

a spacing calculation section that calculates the spacing between the identified spectral peak frequencies; and a harmonic frequency calculation section that calculates the harmonic frequency using the spacing between the identified spectral frequencies.

4. The audio signal decoding apparatus according to claim 1, wherein the harmonic frequency adjustment section comprises:

a low frequency spectral peak identification section that identifies a maximum frequency of a spectral peak in the synthesized low frequency spectrum;

a high frequency spectral peak identification section that identifies a plurality of spectral peak frequencies in the replicated high frequency subband spectrum; and an adjustment section that uses, as a reference, the maximum frequency of the spectral peak in the synthesized low frequency spectrum to adjust the plurality of spectral peak frequencies so that the spacing between the plurality of spectral peak frequencies is equal to the estimated harmonic frequency.

5. The audio signal decoding apparatus according to claim 1, wherein the harmonic frequency adjustment section comprises:

a low frequency spectral peak identification section that identifies a maximum frequency of a spectral peak in the synthesized low frequency spectrum;

a high frequency spectral peak identification section that identifies a plurality of spectral peak frequencies in the replicated high frequency subband spectrum;

a spectral peak frequency calculation section that calculates, as possible spectral peak frequencies, frequencies obtained by adding a frequency integer times the estimated harmonic frequency to the maximum frequency of the spectral peak in the synthesized low frequency spectrum; and an adjustment section that adjusts the plurality of spectral peak frequencies in the replicated high frequency subband spectrum to the closest frequency of the calculated possible spectral peak frequencies.

6. The audio signal decoding apparatus according to claim 1, further comprising:

a missing harmonic component identification section that identifies a harmonic component missing in the synthesized low frequency spectrum based on the estimated harmonic frequency; and a harmonic injection section that injects the missing harmonic component into the synthesized low frequency spectrum.

7. The audio signal decoding apparatus according to claim 6, wherein the harmonic injection section generates a harmonic component having, as an amplitude, an average value of amplitudes of all harmonic components which are not missing, or an average value of amplitudes of harmonic components at positions preceding and following the missing harmonic component on a frequency axis.

8. An audio signal decoding apparatus comprising:

a demultiplexing section that demultiplexes core encoding parameters, index information, scale factor information, and flag information;

a core decoding section that decodes the core encoding parameters to a time domain low frequency signal and transforms the decoded low frequency signal to a frequency domain to obtain a synthesized low frequency spectrum;

a spectrum replication section that reconstructs a high frequency subband spectrum based on the index information using the synthesized low frequency spectrum;

a spectrum envelope adjustment section that adjusts an amplitude of the replicated high frequency subband spectrum using the scale factor information;

a harmonic frequency estimation section that estimates a harmonic frequency from the synthesized low frequency spectrum;

a harmonic frequency adjustment section that adjusts a frequency of a tonal component in the high frequency subband spectrum replicated from the synthesized low frequency spectrum based on the estimated harmonic frequency; and a determination section that determines whether or not the harmonic frequency adjustment section is activated based on the flag information, the audio signal decoding apparatus generating an output signal using the synthesized low frequency spectrum and the high frequency subband spectrum.

9. The audio signal decoding apparatus according to claim 8, further comprising:

a missing harmonic component identification section that identifies a harmonic component missing in the synthesized low frequency spectrum based on the estimated harmonic frequency; and a harmonic injection section that injects the missing harmonic component into the synthesized low frequency spectrum.

10. The audio signal decoding apparatus according to claim 9, wherein the harmonic injection section generates a harmonic component having, as an amplitude, an average value of amplitudes of all harmonic components which are not missing, or an average value of amplitudes of harmonic components at positions preceding and following the missing harmonic component on a frequency axis.

11. An audio signal encoding apparatus comprising:

a down-sampling section that down-samples an input signal) to a lower sampling rate;

a core encoding section that encodes the down-sampled signal into core encoding parameters and outputs the core encoding parameters as well as locally decodes the core encoding parameters and transforms the decoded signal to a frequency domain to obtain a synthesized low frequency spectrum;

an energy normalization section that normalizes the synthesized low frequency spectrum;

a time-frequency transformation section that transforms the input signal to a spectrum and split a frequency spectrum higher than the synthesized low frequency spectrum into a plurality of subbands;

a similarity search section that identifies the most correlated portion from the normalized synthesized low frequency spectrum for each of the subbands and outputs the identification result as index information;

a scale factor estimation section that estimates an energy scale factor between each of the subbands and the most correlated portion identified from the synthesized low frequency spectrum and outputs the scale factor as scale factor information;

a harmonic frequency estimation section that estimates a harmonic frequency of the synthesized low frequency spectrum and a harmonic frequency of the transformed input signal; and a harmonic frequency comparison section that compares the two harmonic frequencies and decides whether or not a harmonic frequency adjustment should be performed and outputs the decision result as flag information.

12. An audio signal encoding apparatus comprising:

a down-sampling section that down-samples an input signal to a lower sampling rate;

a core encoding section that encodes the down-sampled signal into core encoding parameters and outputs the parameters as well as locally decodes the core encoding parameters and transforms the decoded signal into a frequency domain to obtain a synthesized low frequency spectrum;

a time-frequency transformation section that transforms the input signal to a spectrum and split a frequency spectrum higher than the synthesized low frequency spectrum into a plurality of subbands;

a similarity search section that identifies the most correlated portion from the low frequency spectrum for each of the subbands and outputs the identification result as index information;

a scale factor estimation section that estimates an energy scale factor between each of the subbands and the most correlated portion identified from the synthesized low frequency spectrum and outputs the scale factor as scale factor information; and a harmonic frequency estimation section that estimates and outputs a harmonic frequency of the synthesized low frequency spectrum and a harmonic frequency of the transformed input signal.

13. An audio signal decoding method comprising:

receiving encoded information comprising core encoding parameters, index information, and scale factor information;

decoding the core encoding parameters to obtain a synthesized low frequency spectrum;

replicating a high frequency subband spectrum based on the index information using the synthesized low frequency spectrum; and adjusting an amplitude of the replicated high frequency subband spectrum using the scale factor information, generating an output signal using the synthesized low frequency spectrum and the high frequency subband spectrum, the method further comprising:

estimating a frequency of a harmonic component in the replicated high frequency subband spectrum; and adjusting a frequency of a harmonic component in a high frequency spectrum using the harmonic frequency estimated using the synthesized low frequency spectrum.

14. A non-transitory storage medium having stored thereon a computer program for performing, when running on a computer or a processor, the method of claim 13.

15. An audio signal decoding method comprising:

receiving encoded information comprising core encoding parameters, index information, scale factor information, and flag information;

decoding the core encoding parameters to a time domain low frequency signal and transforming the decoded low frequency signal to a frequency domain to obtain a synthesized low frequency spectrum;

reconstructing a high frequency subband spectrum based on the index information using the synthesized low frequency spectrum;

adjusting an amplitude of the replicated high frequency subband spectrum using the scale factor information;

estimating a harmonic frequency from the synthesized low frequency spectrum;

adjusting a frequency of a tonal component in the high frequency subband spectrum replicated from the synthesized low frequency spectrum based on the estimated harmonic frequency; and determining, whether or not the adjusting a frequency of a tonal component is activated based on the flag information, wherein an output signal is generated using the synthesized low frequency spectrum and the high frequency subband spectrum.

16. A non-transitory storage medium having stored thereon a computer program for performing, when running on a computer or a processor, the method of claim 15.

17. An audio signal encoding method comprising:

down-sampling an input signal to a lower sampling rate;

encoding the down-sampled signal into core encoding parameters and outputting the core encoding parameters and decoding the core encoding parameters and transforming the decoded signal to a frequency domain to obtain a synthesized low frequency spectrum;

normalizing the synthesized low frequency spectrum;

transforming the input signal to a spectrum and split a frequency spectrum higher than the synthesized low frequency spectrum into a plurality of subbands;

identifying the most correlated portion from the normalized synthesized low frequency spectrum for each of the subbands and outputting the identification result as index information;

estimating an energy scale factor between each of the subbands and the most correlated portion identified from the synthesized low frequency spectrum and outputting the scale factor as scale factor information;

estimating a harmonic frequency of the synthesized low frequency spectrum and a harmonic frequency of the transformed input signal; and comparing the two harmonic frequencies and deciding whether or not a harmonic frequency adjustment should be performed and outputting the decision result as flag information.

18. A non-transitory storage medium having stored thereon a computer program for performing, when running on a computer or a processor, the method of claim 17.

19. An audio signal encoding method comprising:

down-sampling an input signal to a lower sampling rate;

encoding the down-sampled signal into core encoding parameters and outputting the parameters as well as decoding the core encoding parameters and transforming the decoded signal into a frequency domain to obtain a synthesized low frequency spectrum;

transforming the input signal to a spectrum and splitting a frequency spectrum higher than the synthesized low frequency spectrum into a plurality of subbands;

identifying the most correlated portion from the low frequency spectrum for each of the subbands and outputting the identification result as index information;

estimating an energy scale factor between each of the subbands and the most correlated portion identified from the synthesized low frequency spectrum and outputting the scale factor as scale factor information; and estimating and outputting a harmonic frequency of the synthesized low frequency spectrum and a harmonic frequency of the transformed input signal.

20. A non-transitory storage medium having stored thereon a computer program for performing, when running on a computer or a processor, the method of claim 19.

* * * * *